US007837570B2

(12) United States Patent
Kwon

(10) Patent No.: US 7,837,570 B2
(45) Date of Patent: Nov. 23, 2010

(54) SWING DEVICE HAVING CIRCUIT FOR GENERATING REPULSIVE FORCE

(75) Inventor: Young-han Kwon, Gyeonggi-do (KR)

(73) Assignee: Kukutoys Co., Ltd., Gyeonggi-do (KR)

( * ) Notice: Subject to any disclaimer, the term of this patent is extended or adjusted under 35 U.S.C. 154(b) by 462 days.

(21) Appl. No.: 11/996,821

(22) PCT Filed: Jul. 27, 2006

(86) PCT No.: PCT/KR2006/002962

§ 371 (c)(1),
(2), (4) Date: Feb. 6, 2008

(87) PCT Pub. No.: WO2007/013770

PCT Pub. Date: Feb. 1, 2007

(65) Prior Publication Data

US 2008/0194349 A1 Aug. 14, 2008

(30) Foreign Application Priority Data

Jul. 27, 2005 (KR) ..... 10-2005-0068641

(51) Int. Cl.
*A63G 9/16* (2006.01)
*A63G 9/00* (2006.01)

(52) U.S. Cl. ..... 472/119; 5/108

(58) Field of Classification Search ..... 472/118–125; 297/273–283; 5/105–109
See application file for complete search history.

(56) References Cited

U.S. PATENT DOCUMENTS 3,842,450 A * 10/1974 Pad ..... 5/109

(Continued)

FOREIGN PATENT DOCUMENTS

JP 53-034365 3/1978

(Continued)

OTHER PUBLICATIONS

International Search Report for PCT/KR2006/002962 dated Nov. 13, 2006.

*Primary Examiner*—Kien T Nguyen
(74) *Attorney, Agent, or Firm*—Nixon Peabody LLP; Jeffrey L. Costellia

(57) ABSTRACT

A swing device has a support frame, a seat having a swing axis and swing back and forth about the swing axis while a bar thereof being hung on the support frame, and a repulsive circuit for repelling a permanent magnet installed on the swing axis. The repulsive circuit has a coil assembly instantly generating induced current when the permanent magnet passes by with a certain distance therebetween, and being supplied with power to become an electromagnet having the same polarity as the permanent magnet to instantly repel the permanent magnet, a first switching element for switching the induced current generated in the coil assembly, a second switching element switched on by the induced current switched from the first switching element to turn off the switching operation of the first switching element and to control a power switching operation at the same time, and a power switching unit for temporarily switching the power to the coil assembly according to the control of the power switching operation of the second switching element. According to the swing device, the construction of the circuit becomes simplified, manufacturing cost of products is reduced, and the possibility to cause the malfunction of the circuit is reduced.

6 Claims, 4 Drawing Sheets

U.S. PATENT DOCUMENTS 4,491,317 A * 1/1985 Bansal ..... 472/119
4,616,824 A 10/1986 Quinlan, Jr. et al.
5,183,457 A * 2/1993 Gatts et al. ..... 600/21
5,833,545 A * 11/1998 Pinch et al. ..... 472/119
6,854,138 B2 * 2/2005 Xu ..... 5/106
6,872,146 B1 * 3/2005 Paesang et al. ..... 472/119
6,908,398 B1 * 6/2005 Kang ..... 472/119
6,916,249 B2 7/2005 Meade
7,234,177 B1 * 6/2007 Drevitson ..... 5/120

FOREIGN PATENT DOCUMENTS

KR 88-0004227 5/1988

* cited by examiner

[Fig. 1]
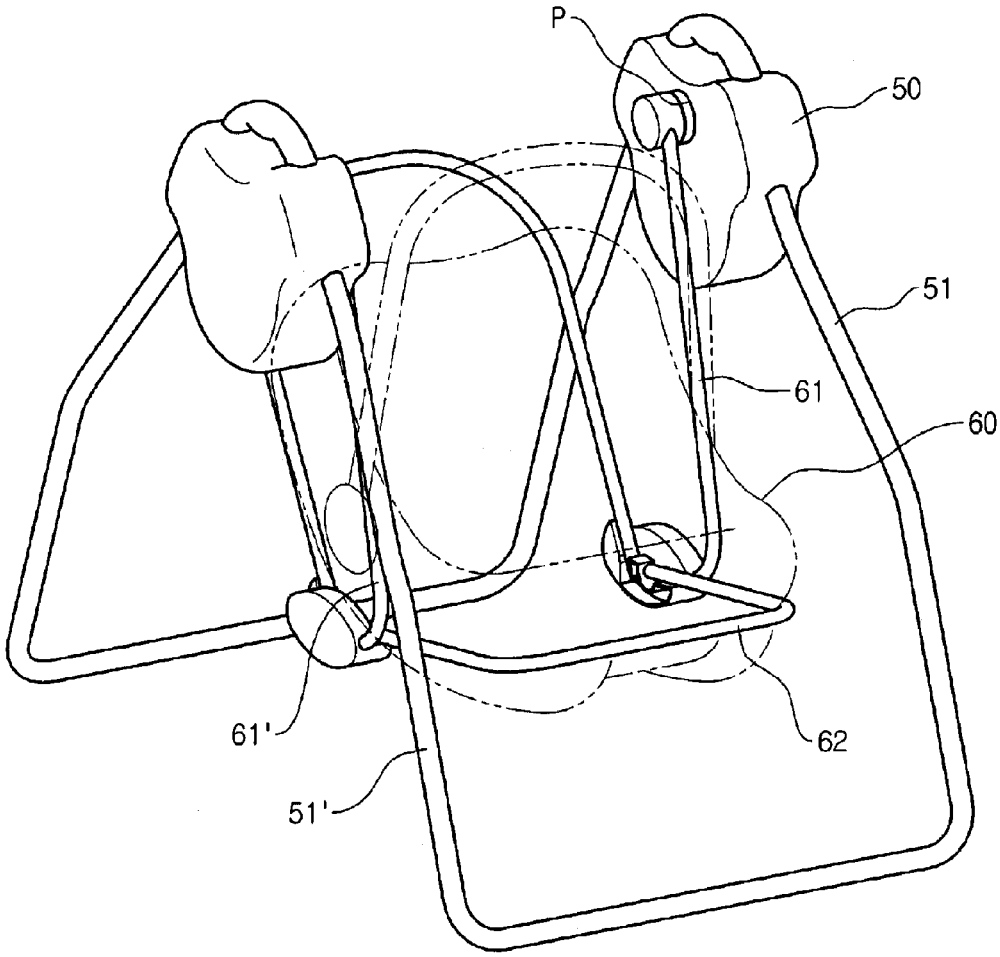
[Fig. 2]
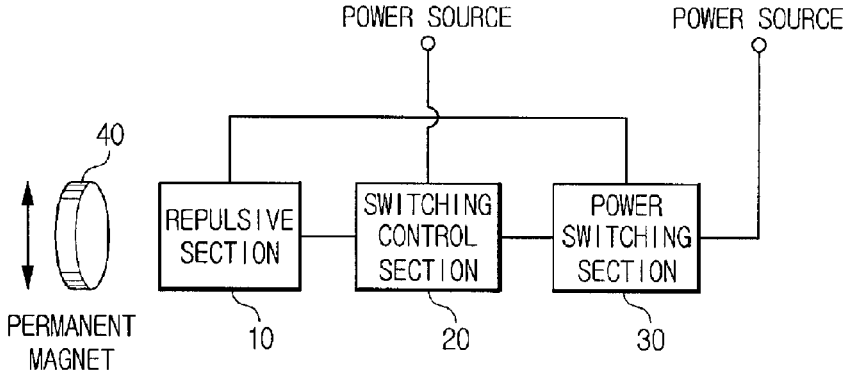

[Fig. 3]
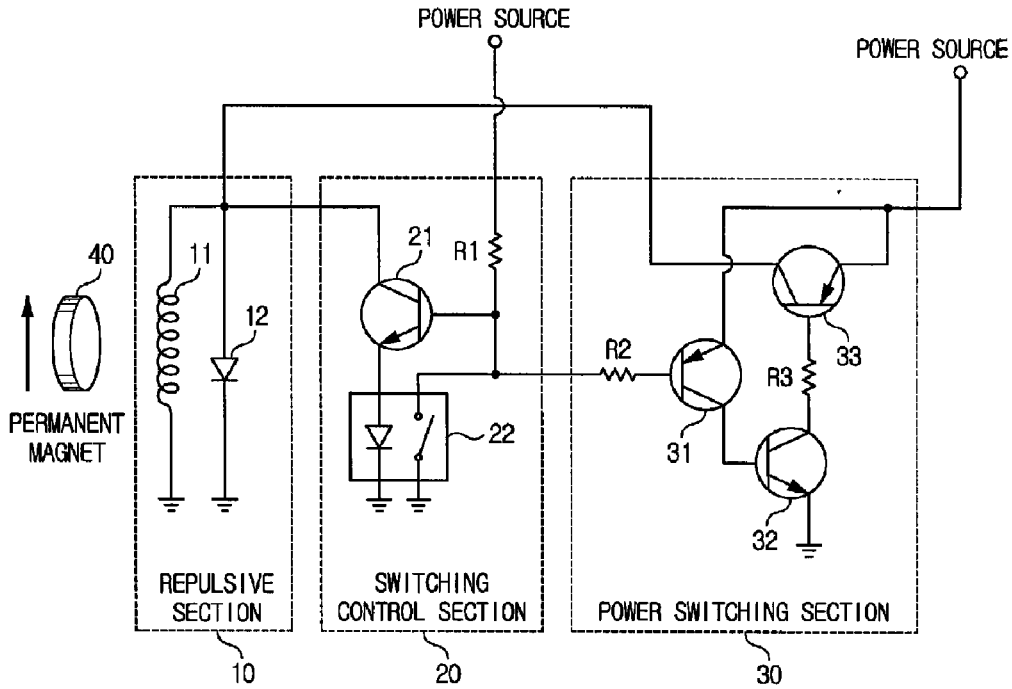
[Fig. 4]
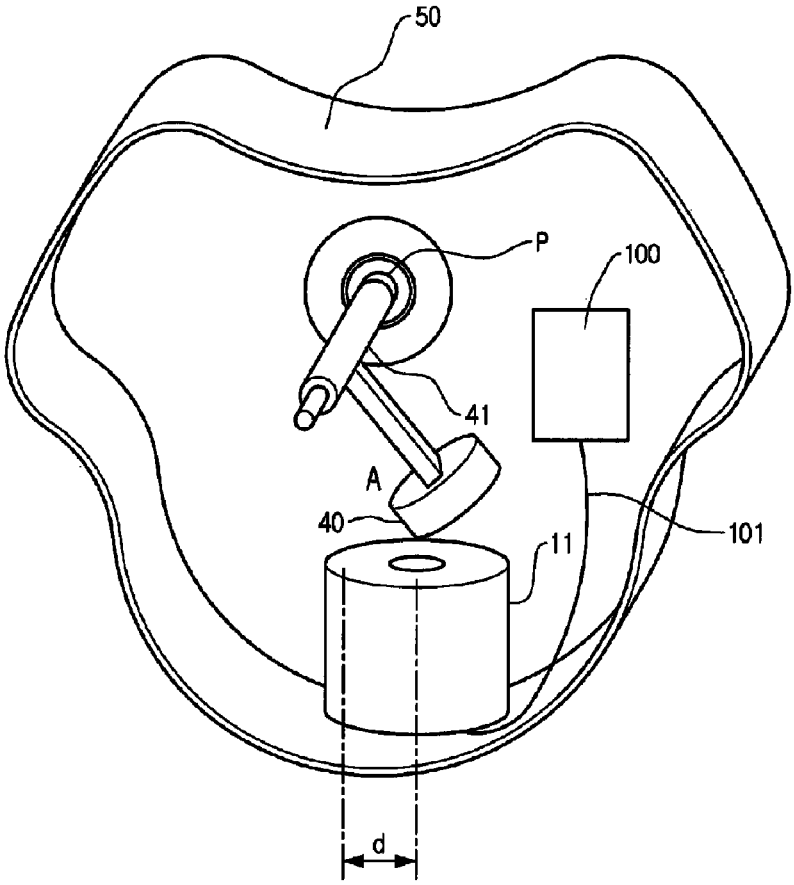

[Fig. 5]
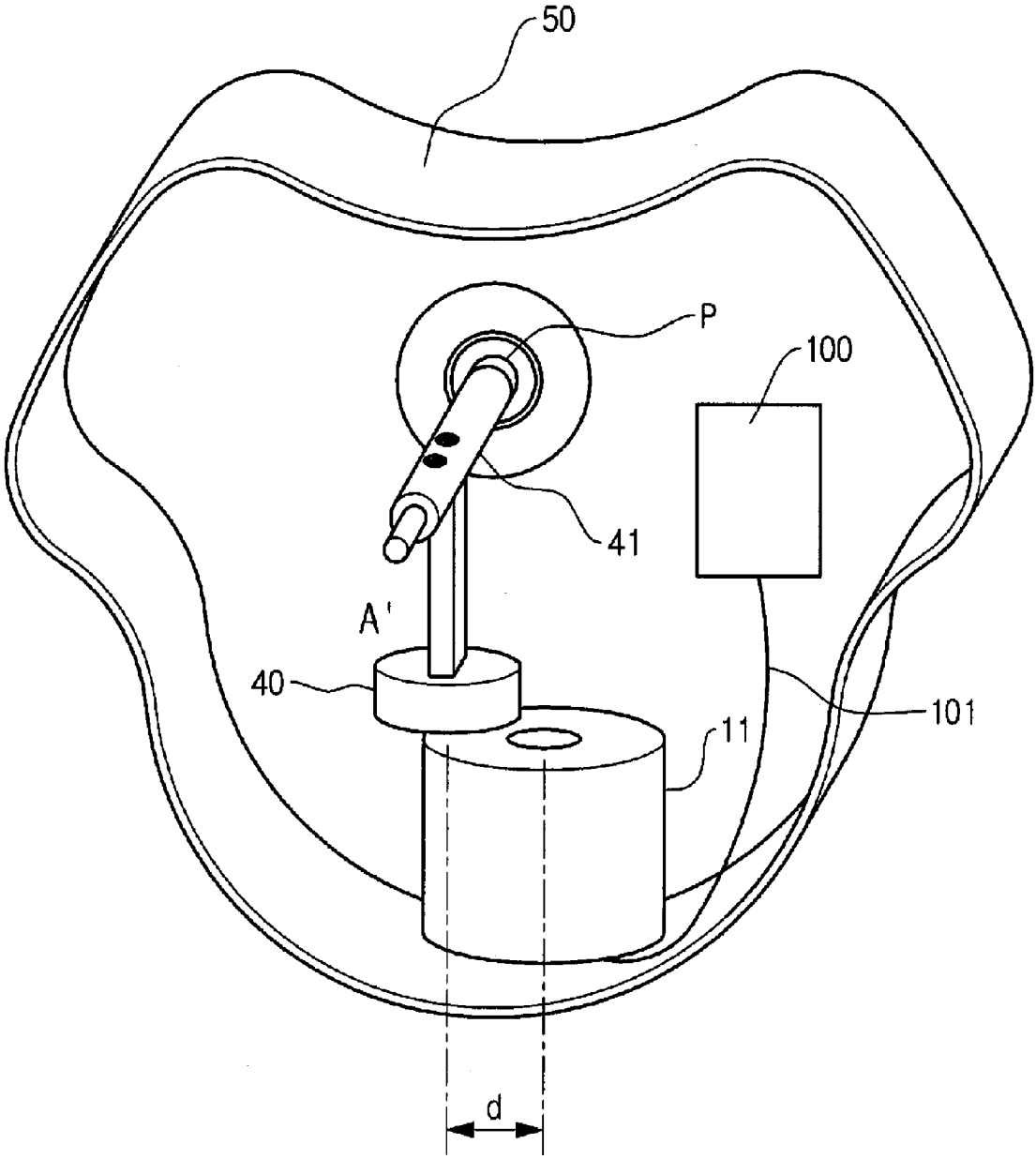

[Fig. 6]
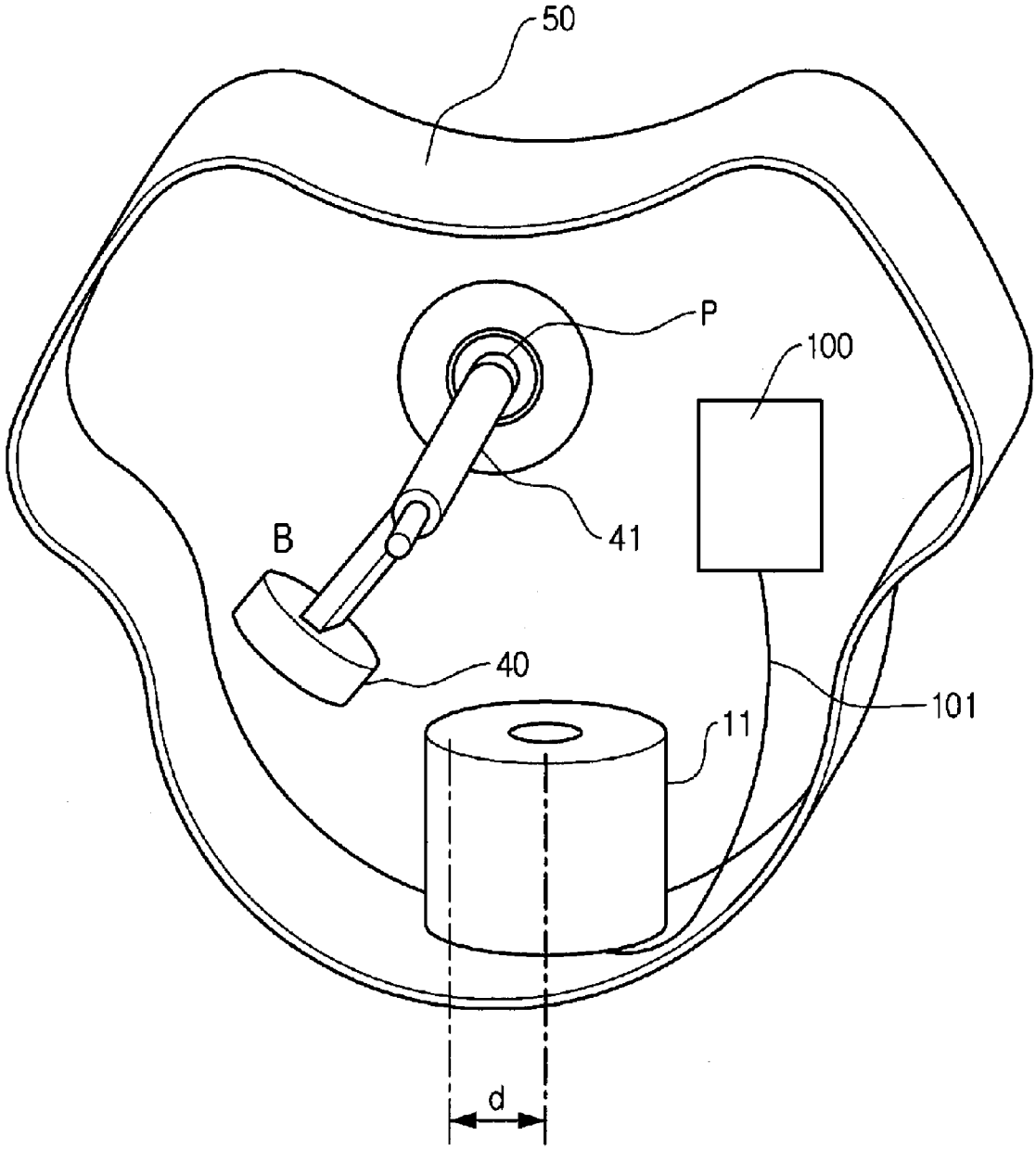

SWING DEVICE HAVING CIRCUIT FOR GENERATING REPULSIVE FORCE

TECHNICAL FIELD

The present invention relates to a swing device having a circuit for generating a repulsive force, and more particularly to a swing device for an infant, such as a swing or a cradle, having a circuit for generating a repulsive force, which allows to automatically swing using an electromagnetic force.

BACKGROUND ART

In general, a swing device for an infant has being operated such that it is swung back and forth at a regular time and interval, allowing an infant to get comfortable sleep or to play it. Although in the past, such swing device had been manually swung by the protector of an infant, recently, in order to dispense with such trouble, it has being developed an automatic swing device, which is automatically swung using external power.

Such automatic swing device may be divided by the drive mechanism into an electric type in which a rotational shaft of a cradle or a swing is directly driven by a motor, and an electromagnetic type in which a cradle or a swing is swung using a repulsive force between a permanent magnet and an electromagnet.

The electric type swing device between them has a problem in that since it operates by a motor, operational noise is generated and power consumption is large.

On the other hand, the conventional electromagnetic swing device is configured such that a permanent magnet is arranged on a seat on which an infant will sit down, an electromagnet is arranged on both positions back and forth along a rotational direction of the seat, and polarity is selectively changed so that the seat is swung back and forth by the repulsive force between the permanent magnet and the electromagnet. That is, when the permanent magnet approaches the electromagnet, the polarity of the electromagnet is changed identically to that of the permanent magnet to thus create a repulsive force between the permanent magnet and the electromagnet so that the seat is in turn swung in opposite direction by the repulsive force.

In building the swing device, the time to magnetize the electromagnet is very important. That is, it is the decision for the time of supplying the electromagnet with power. To this end, in the past, the respective electromagnets had been selectively changed through detecting a rotational angle of a seat using a photo sensor.

However, such electromagnetic type swing device has the problems in that if the photo sensor detects wrong positions of the seat, the polarity of the electromagnet adjacent to the permanent magnet is changed reversely to that of the permanent magnet to cause a malfunction such as stopping the seat at that position, as well as the structure thereof is complex.

Therefore, there is a need for a swing device that has a circuit for generating a repulsive force, capable of creating driving force with a simple construction using a permanent magnet and an electromagnet. Such circuit should also serve as a sensor for detecting a position of a swinging object, for example, the photo sensor as set forth above, and prevent the malfunction to detect a wrong position of the swinging object.

DISCLOSURE OF INVENTION

Technical Problem

Accordingly, the present invention has been made to solve the above-mentioned problems occurring in the prior art, and an object of the present invention is to provide a swing device having a circuit for generating a repulsive force, capable of securing an electromagnetic driving type having no possibility of malfunction.

Another object of the present invention is to provide a swing device having a circuit for generating a repulsive force to detect the approaching of a permanent magnet and to repel the corresponding permanent magnet at the same time, using a single element, so that the construction of the circuit becomes simplified and manufacturing cost of products is thus reduced.

Still another object of the present invention is to provide a swing device having a circuit for generating a repulsive force to detect the approaching of a permanent magnet and to repel the corresponding permanent magnet at the same time, through generating induced current using a single coil when the permanent magnet passes by, so that a sensor separately provided in the past is removed to thus reduce the possibility to cause the malfunction of the circuit to detect a wrong position of a swinging object.

Technical Solution

In order to accomplish the above objects, there is provided a swing device comprising a support frame, a seat having a swing axis and swing back and forth about the swing axis while a bar thereof being hung on the support frame, and a repulsive circuit for repelling a permanent magnet installed on the swing axis, wherein the repulsive circuit includes a coil assembly instantly generating induced current when the permanent magnet passes by with a certain distance therebetween, and being supplied with power to become an electromagnet having the same polarity as the permanent magnet to instantly repel the permanent magnet, a first switching element for switching the induced current generated in the coil assembly, a second switching element switched on by the induced current switched from the first switching element to turn off the switching operation of the first switching element and to control a power switching operation at the same time, and a power switching unit for temporarily switching the power to the coil assembly according to the control of the power switching operation of the second switching element.

The repulsive circuit may further include a diode for cutting off current when generated in opposite direction to the induced current in the coil assembly so as not to be applied to the first switching element.

The first switching element may be a transistor.

The second switching element may be a photocoupler or a relay.

The power switching unit may include a switching element for temporarily switching the power to the coil assembly according to the control of the power switching operation of the second switching element.

The switching element may include a first transistor switched on according to the control of the power switching operation of the second switching element to switch the power, a second transistor switched on by the power switched from the first transistor to perform the power switching control, and a third transistor for switching the power to the coil assembly according to the power switching control of the second transistor.

BRIEF DESCRIPTION OF THE DRAWINGS

The above and other objects, features and advantages of the present invention will be more apparent from the following detailed description taken in conjunction with the accompanying drawings, in which:

FIG. 1 is a view showing a swing device having a circuit for generating a repulsive force according to an embodiment of the present invention;

FIG. 2 is a block diagram showing in brief a repulsive circuit according to an embodiment of the present invention;

FIG. 3 is a circuit diagram showing in detail the repulsive circuit in FIG. 2; and FIGS. 4 to 6 are views showing a procedure of driving a swing device through generating a repulsive force according to the swing movement of a permanent magnet, using the repulsive circuit adapted to the swing device.

MODE FOR THE INVENTION

A swing device according to the present invention is configured to generate induced current when a permanent magnet passes by, using a single coil, to detect approaching of the permanent magnet, and to switch power to the corresponding coil to repel the corresponding permanent magnet as well. Hereinafter, preferred embodiments of the present invention will be described with reference to the accompanying drawings.

A circuit for generating a repulsive force (also referred to as a repulsive circuit) according to an embodiment of the present invention, as shown in FIG. 2, includes a repulsive force generating section 10 (also referred to as a repulsive section), a switching control section 20, and a power switching section 30. Herein, the power supplied to the switching control section 20 and the power switching section 30 is power applied from a battery or other power supply device. A permanent magnet 40 spaced to a certain distance from the corresponding repulsive section 10 is mounted on an object moving relative to another fixed object on which the corresponding repulsive section 10 is mounted.

The repulsive section 10 detects an approach of the permanent magnet 40 in such a manner that it detects the case when the permanent magnet 40 passes by the repulsive section 10 with a certain distance therebetween (that is, when a distance between the permanent magnet 40 and the repulsive section 10 becomes a certain distance) and creates a permanent magnet approaching signal (e.g., induced current) to be informed to the switching control section 20. Herein, the certain distance is a value obtained by an experiment and a test and meaning a distance that when a repulsive force is created between the repulsive section 10 and the permanent magnet 40, the repulsive section 10 can repel the permanent magnet 40 to the maximum. Furthermore, the repulsive section 10 is supplied with power switched from the power switching section 30 to become an electromagnet having the same polarity as the permanent magnet 40 so that a repulsive force is created between the corresponding electromagnet and the permanent magnet 40 and thus the electromagnet instantly repels the permanent magnet 40.

The switching control section 20 is supplied with power from a battery or other power supply device to perform a control operation for power switching. At this time, the power switching operation of the power switching section 30 is controlled according to the permanent magnet approaching signal informed from the repulsive section 10.

The power switching section 30 switches to the repulsive section 10 the power applied from a battery or other power supply device according to the power switching control of the switching control section 20.

The circuit for generating a repulsive force, i.e., the repulsive circuit, according to an embodiment of the present invention will now be described in detail with reference to the circuit diagram of FIG. 3.

As shown in FIG. 3, the repulsive section 10 includes a coil 11 and a diode 12. Herein, it should be noted that the coil 11 is a coil assembly so that for example, two-wire coil can be used as the coil.

The coil 11 is an element serving to detect an approach of the permanent magnet 40 and also to repel the permanent magnet 40 (i.e., permanent magnet detecting/repelling element), which instantly creates and applies induced current to the switching control section 20 when the permanent magnet 40 passes by the coil 11 with a certain distance therebetween, is supplied with power switched from a third transistor 33 of the power switching section 30 to become an electromagnet having the same polarity as the permanent magnet 40 so that a repulsive force is created between the electromagnet and the permanent magnet 40 and thus the electromagnet repels the permanent magnet instantly.

The diode 12 is an element for cutting off inverse current generated in the case where the permanent magnet 40 passes by in reverse direction for the coil 11 (i.e., an inverse current cutting off element), which prevents the application of inverse current, if generated, to the switching control section 20, making it possible for the switching control section 20 to accurately determine an approach of the permanent magnet 40, that is, the time when the power switching section 30 switches power to the repulsive section 10.

The switching control section 20 includes a transistor 21, a photocoupler 22, and a resistance R1. Although the photocoupler 22 has been used herein, it should be understood that the present invention is not limited thereto but may use other switching element such as a relay element.

The transistor 21 is an element, such as an NPN type transistor, for switching to the photocoupler 22 induced current applied from the repulsive section 10 (i.e., a switching element), which performs a switching operation while being continuously supplied with power applied from a battery or other power supply device via its base terminal, and on the other hand, interrupts the switching operation when power supplied via the base terminal is grounded by the corresponding photocoupler 22, thereby preventing induced current from being applied furthermore from the coil 11 of the repulsive section 10.

The photocoupler 22 is an element switched on by induced current from the transistor 21 to ground power applied from a battery or other power supply device (i.e., a switching element), which is applied with induced current from the transistor 21 to be switched on to ground power applied to the base terminals of the transistor 21 and the first transistor 31 of the power switching section 30.

The power switching section 30 includes a plurality of transistors 31 to 33 and a plurality of resistances R2 and R3. Herein, although three transistors 31 to 33 are used as a switching element in order for the power switching section 30 to perform the power switching operation more accurately and quickly, it should be understood that the present invention is not limited thereto, but may be configured irrespective of the number of the switching elements or other switching elements for more accurate and quick power switching operation.

The first transistor 31 is an element, such as a PNP type transistor, for switching to corresponding second transistor 32 power applied from a battery or other power supply device according to the power switching control of the switching control section 20 (i.e., a switching element), which is continuously supplied with power applied from a battery or other power supply device via its base terminal to maintain its switching off state, and if the power supplied via the corresponding base terminal is grounded by the photocoupler 22 of the switching control section 20, to perform its switching operation.

The second transistor 32 is an element, such as an NPN type transistor, switched on according to the power switching control of the first transistor 31 to ground the base terminal of the third transistor 33 (i.e., a switching element), which is switched on with the application of the power switched from the first transistor via its base terminal to ground the base terminal of the third transistor 33.

The third transistor 33 is an element, such as a PNP type transistor, for switching to the coil 11 of the repulsive section 10 the power applied from a battery or other power supply device according to the power switching control of the second transistor 32 (i.e., a switching element), which performs the switching operation when its base terminal is grounded by the second transistor 32.

An operation of the repulsive circuit according to an embodiment of the present invention will now be described.

First, when the permanent magnet 40 installed on an object moving relative to a fixed object having the repulsive section 10 installed thereon passes by the coil assembly 11 provided in the repulsive section 10, the coil assembly 11 composed of two-wire coil and so firth instantly generates a permanent magnet approaching signal when the permanent magnet 40 passes by with a certain distance therebetween and informs the switching control section 20 of it. That is, it creates and applies induced current to the switching control section 20.

Herein, as illustrated in FIGS. 4 to 6, the certain distance d means a distance that when a repulsive force is created between the coil assembly 11 and the permanent magnet 40, the coil assembly 11 can repel the permanent magnet 40 to the maximum with the repulsive force created.

At this time, inverse current is also generated when the permanent magnet 40 passes by in reverse direction for the coil assembly 11, and in order to cut off inverse current as generated, the diode 12 connected in parallel to the coil assembly 11 is further provided to the repulsive section 10 so that inverse current, if generated, is prevented from applying to the switching control section 20 by the diode 12.

The switching control section 20 is supplied with power applied from a battery or other power supply device to control the power switching operation of the power switching section 30 according to the permanent magnet approaching signal informed from the repulsive section 10.

An operation of the switching control section 20 will now be described in detail with reference to the circuit diagram of FIG. 3. The transistor 21 provided in the switching control section 20 is an NPN type transistor, which is maintained to a state (i.e., a 'high' level state) in which it is continuously supplied with the power applied from a battery or other power supply device via its base terminal, and if applied with induced current generated from the coil assembly 11 of the repulsive section 10, it switches induced current to the photocoupler 22 provided in the switching control section 20.

The photocoupler 22 is switched on by the induced current switched through the transistor 21 to thus ground power applied from a battery or other power supply device. That is, it grounds power applied to the base terminal of the transistor 21 and power applied to the power switching section 30 for controlling the power switching operation of the power switching section 30.

Accordingly, the power applied via the base terminal of the transistor 21 is grounded by the photocoupler 22, that is, the base terminal is changed into a 'low' level state, so that the transistor 21 interrupts the switching operation described above, preventing the induced current from being applied furthermore from the coil assembly 11 of the repulsive section 10.

At the same time, the power switching section 30 switches to the coil assembly 11 of the repulsive section 10 the power applied from a battery or other power supply device according to the power switching control of the switching control section 20.

An operation of the power switching section 30 will now be described in detail with reference to the circuit diagram of FIG. 3. The first transistor 31 provided in the power switching section 30 is a PNP type transistor, which is maintained to a state (i.e., a 'high' level state) in which it is continuously supplied with the power applied from a battery or other power supply device via its base terminal, and if the power being applied via its base terminal is grounded by the photocoupler 22 of the switching control section 20, that is, the base terminal becomes a switched on state through changing into a 'low' level state, so that the power applied from a battery or other power supply device is switched to the second transistor 32 provided in the power switching section 30.

The second transistor 32 is an NPN type transistor that is applied with the power ('high' level state) switched from the first transistor 31 via its base terminal to be a switched on state, thereby grounding the base terminal of the third transistor 33 that is connected with its emitter terminal and provided in the power switching section 30.

Therefore, the third transistor 33 is a PNP type transistor, which switches to the coil assembly 11 of the repulsive section 10 the power applied from a battery or other power supply device, through grounding of its base terminal connected to the emitter terminal of the second transistor 32 with the second transistor 32, that is, through becoming to a switched on state with the change of its base terminal into a 'low' level state.

Then, the power applied from a battery or other power supply device is supplied to the coil assembly 11 so that the coil assembly 11 becomes an electromagnet having the same polarity as the permanent magnet 40 by the power switched from the power switching section 30 to thus generate a repulsive force reacting between the electromagnet and the permanent magnet 40, thereby instantly repelling the permanent magnet 40.

The power applied from a battery or other power supply device is the power that is temporarily supplied to the coil assembly 11, which is not supplied furthermore to the coil assembly 11 after repelling once the permanent magnet 40 with the operation described above. Then, when the permanent magnet 40 passes by the coil assembly 11 again with a certain distance therebetween, the operation as described above will be repeated.

FIGS. 4 to 6 are views showing a procedure of driving a swing device through generating a repulsive force as the permanent magnet is swung, with adaptation of the repulsive circuit to the swing device.

For example, as illustrated in FIG. 1, the swing device swing back and forth with the repulsive circuit according to an embodiment of the present invention includes a support frame 50 and a seat 60 (depicted in a ghost line in the drawing) hung on the support frame 50 as to be swung back and forth.

The support frame 50 consists of a pair of triangular frames 51 and 51' opposed to a certain distance with each other. The seat 60 is connected with its pair of bars 61 and 61' with the upper portions of the respective frames 51 and 51' as to be swung. That is, the seat 60 is detachably placed on a seat holder 62, the lower portions of the respective bars 61 and 61 are connected to the respective seat holders 62, and the upper portion of the respective bars 61 and 61' are rotatably connected to the upper portion of the respective frames 51 and 51' so that the seat 60 can be swung about a center P of rotation placed at the upper portions of the respective bars 61 and 61'

Further, the support frame 50 is connected to the upper portion of the respective bars 61 and 61' and as illustrated in FIGS. 4 to 6, the support frame 50 includes therein a permanent magnet fixing member 41 and a coil assembly 11 fixedly installed directly under the permanent magnet 40.

Herein, when the seat 60 is positioned at the center position, the permanent magnet 40 and the coil assembly 11 are preferably separated to a certain distance d enough to be repelled with each other to the maximum. Further, the permanent magnet fixing member 41 can be swung back and forth about the center of rotation P together with the permanent magnet 40.

As shown in FIG. 4, when the permanent magnet 40 reaches a certain position A by a certain external force while being swung in association with the seat 60 hanging on the support frame 50, induced current is instantly generated in the coil assembly as described before and applied to the photocoupler 22 of the switching control section 20.

The photocoupler 22 then becomes a switched on state and the external power is grounded so that current applied to the photocoupler 22 is switched off to prevent the induced current from being applied furthermore from the coil assembly 11 of the repulsive section 10.

Meanwhile, the photocoupler 22 then becomes a switched on state and the external power is grounded so that current applied to the photocoupler 22 is switched off to apply current supplied from the exterior to the coil assembly 11 of the repulsive section 10, thereby magnetizing it. The permanent magnet 40 is instantly repelled by the repulsive force generated between the permanent magnet 40 and the coil assembly 40 switched into an electromagnet. Herein, the repelling time is when the permanent magnet 40 cooperated with the seat 60 reaches a position A' as shown in FIG. 5, having a certain distance d therebetween that both can be repelled to the maximum force obtained by an experiment and a test.

The photocoupler 22 is switched off to return to its initial state.

As shown in FIG. 6, the permanent magnet 40 is swung to a position B by repulsive force therebetween, and when it passes over the coil assembly 11 again to a position as shown in FIG. 5 by gravity, inverse current, if generated, is not applied to the switching control section 20 by an operation of the diode 12 of the repulsive section 10 so that the repulsive circuit 100 does not operate. Then, the permanent magnet 40 is swung again to move to a position as shown in FIG. 4. Then, if an external force is not exerted, the swing device having the seat 60 cooperated with the permanent magnet 40 according to an embodiment of the present invention can be continuously swung by the repulsive circuit 100.

When the power applied from a battery or other power supply device is supplied to the coil assembly 11 with the performance of an operation of the repulsive circuit 100, the coil assembly 11 becomes an electromagnet having the same polarity as the permanent magnet 40 to thus generate a repulsive force therebetween, so that the electromagnet instantly repels the permanent magnet 40. Accordingly, the permanent magnet fixing member 41 is swung back and forth about the center of rotation P together with the respective bars 61 and 61' so that the seat 60 can be finally swung back and forth.

Although preferred embodiments of the present invention have been described for illustrative purposes, those skilled in the art will appreciate that various modifications, additions and substitutions are possible, without departing from the scope and spirit of the invention as disclosed in the accompanying claims.

INDUSTRIAL APPLICABILITY

As set forth before, according to the present invention, there is provided a swing device having a circuit for generating a repulsive force to detect the approaching of a permanent magnet and to repel the corresponding permanent magnet at the same time, through generating induced current using a single coil when the permanent magnet passes by, so that a sensor separately provided in the past is removed and the construction of the circuit thus becomes simplified, manufacturing cost of products is reduced, and the possibility to cause the malfunction of the circuit is reduced.

The invention claimed is:

1. A swing device comprising a support frame, a seat having a swing axis and swing back and forth about the swing axis while a bar thereof being hung on the support frame, and a repulsive circuit for repelling a permanent magnet installed on the swing axis, wherein the repulsive circuit includes:

a coil assembly instantly generating induced current when the permanent magnet passes by with a certain distance therebetween, and being supplied with power to become an electromagnet having the same polarity as the permanent magnet to instantly repel the permanent magnet;

a first switching element for switching the induced current generated in the coil assembly;

a second switching element switched on by the induced current switched from the first switching element to turn off the switching operation of the first switching element and to control a power switching operation at the same time; and a power switching unit for temporarily switching the power to the coil assembly according to the control of the power switching operation of the second switching element.

2. The swing device as claimed in claim 1, wherein the repulsive circuit further includes a diode for cutting off current when generated in opposite direction to the induced current in the coil assembly so as not to be applied to the first switching element.

3. The swing device as claimed in claim 1, wherein the first switching element is a transistor.

4. The swing device as claimed in claim 1, wherein the second switching element is a photocoupler or a relay.

5. The swing device as claimed in claim 1, wherein the power switching unit includes a switching element for temporarily switching the power to the coil assembly according to the control of the power switching operation of the second switching element.

6. The swing device as claimed in claim 5, wherein the switching element includes a first transistor switched on according to the control of the power switching operation of the second switching element to switch the power;

a second transistor switched on by the power switched from the first transistor to perform the power switching control; and a third transistor for switching the power to the coil assembly according to the power switching control of the second transistor.

* * * * *